US005238496A

United States Patent [19]

Koponen

[11] Patent Number: 5,238,496

[45] Date of Patent: Aug. 24, 1993

[54] PAINTING LINE FOR METAL OBJECTS

[75] Inventor: Raimo V. Koponen, Billnäs, Finland

[73] Assignee: Pohjan Teollisuusmaalaamo Oy, Balsta, Finland

[21] Appl. No.: 769,979

[22] Filed: Oct. 2, 1991

[30] Foreign Application Priority Data

Oct. 4, 1990 [FI] Finland ..... 904901

[51] Int. Cl.[5] ..... B05B 13/00

[52] U.S. Cl. ..... 118/324; 118/641; 118/621; 209/904

[58] Field of Search ..... 118/641, 324, 620, 621; 209/904; 239/690; 198/690.1

[56] References Cited

U.S. PATENT DOCUMENTS

| | | | |
|---|---|---|---|
| 2,794,418 | 6/1957 | Stewart | 118/323 |
| 3,742,907 | 7/1973 | Steffan et al. | 118/324 |
| 3,782,325 | 1/1974 | Farnsworth et al. | 118/58 |
| 4,193,374 | 3/1980 | Mirza | 118/58 |
| 5,085,167 | 2/1992 | Mebels | 118/641 |

*Primary Examiner*—Peter Chin
*Assistant Examiner*—Charles K. Friedman
*Attorney, Agent, or Firm*—Seed and Berry

[57] ABSTRACT

The present invention relates to a painting line for metal objects, such as coating screws and nails, comprising a base for affixing said objects (2) at a space from one another on said base, members (5) for spreading paint on the objects (2) affixed to the base and, if needed, heating elements (6) for fixing the paint on the objects prior to freeing of the base. The base is a magnetic conveyor (1), provided thereunder a feeder (7) known in itself in the art for arranging objects to form at least one individual row to be in contact with the undersurface of the magnetic conveyor (1) so that said conveyor picks one object (2) at a time from each row. The paint spreading members 5 are likewise positioned under the magnetic conveyor (1) after the feeder (7) and separated from the magnetic conveyor by means of a thin sheet (8) disposed thereagainst, against the undersurface of which the objects (2) glide due to the action of the magnet conveyor (1) gliding against the opposite side of said sheet. Finally, a block (9) is disposed on the travel path of the painted objects (2) transported by the magnetic conveyor, in order to drop said objects off from the magnetic conveyor (1).

8 Claims, 2 Drawing Sheets

PAINTING LINE FOR METAL OBJECTS

TECHNICAL FIELD

The present invention relates to a painting line for metal objects and particularly for metal objects provided with heads. This kind of metal objects which are provided with heads are e.g. screws, nails and bolts, and particularly coating screws or nails which are provided with a washer.

BACKGROUND OF THE INVENTION

The invention concerns specifically painting line for metal objects which are provided with a base for engaging objects at a space from one another on said base, and members for spreading paint on the objects attached to said base and, if needed, heating means for fixing the paint on the objects prior to detaching same from said base.

A wide variety of coatings are used nowadays which already have been painted or pretreated so that they need not be painted after being mounted. In that case, also the coating screws or nails used for said mounting have to be pre-painted. Painting such small objects provided with small narrow tips and even pointed tips, possibly provided with a washer, so that the paint can be spread and affixed uniformly on the heads and washers of said objects has turned out to be inconvenient. In order to succeed in said operation, said objects have to be hold at the narrow end during the painting and fixing of the paint.

It is known in the art to paint such coating screws and nails by pushing their tip into an aperture disc or a net, whereafter paint is spread on the coating screws and nails affixed to said aperture disc or net, which after the paint has dried are detached from the base. The affixing and detaching have however to be done as handwork which is costly and time consuming.

Endeavors have been made to automate the painting of coating screws and nails by using groove conveyors into the grooves of which the tips of the coating screws and nails enter so that said head-provided metal objects can be painted when they move past the painting nozzles. The efficiency of said painting lines employing the above-mentioned groove conveyors has however been very low and they frequently encounter operating disturbances because the grooves are filled with paint, after which the transporting capacity of the groove conveyors is disturbed. Keeping said groove conveyors clean has proved highly problematic. In addition, the affixing and detaching of the head-provided metal objects is difficult to automate.

The object of the present invention is to eliminate the drawbacks mentioned above and to provide a painting line for various metal objects, said line having a high, even over 80%, efficiency and being easy to keep clean.

The main characteristic features of the invention become obvious in the accompanying claims.

SUMMARY OF THE INVENTION

In the painting line according to the present invention a magnetic conveyor is used instead of a groove conveyor, which is provided with a feeder known in itself in the art for arranging the objects to one or more adjacent individual rows so joined to the magnetic conveyor so that it catches one object at a time from each row. The paint spreading members are located subsequent to the feeder means in the travel direction of the magnetic conveyor, and the paint spreading members are separated from the magnetic conveyor by a thin sheet disposed thereagainst, against the opposite side of which the objects glide owing to the action of the magnetic conveyor. Subsequent to the potential heating elements, an element is provided on the travel path of the painted objects conveyed by the magnetic conveyor for dropping them off from said magnetic conveyor.

An advantage of the magnetic conveyor is that the metal objects are easy to attach to and detach from the conveyor. The attaching takes place simply by bringing the metal objects close enough to the magnets of the conveyor, and the detaching simply e.g. by preventing said painted metal objects from moving along with the conveyor, so that they just fall down into a collector vessel. Keeping the magnetic conveyor clean is also very simple. In the present invention, the magnetic conveyor has physically been separated from the paint spreading members and the head-provided metal objects to be painted with a thin sheet without breaking the magnetic connection between the conveyor and the head-provided objects to be painted. Thus, the head-provided metal objects to be painted move along with the conveyor although it is physically separated therefrom and from the paint spreading members.

The magnetic conveyor is preferably an endless chain conveyor or equivalent, provided with a plurality of permanent magnets at least at a longitudinal space from one another. Permanent magnets may be provided in two or more adjacent rows, however preferably in two adjacent rows on both sides of the chain conveyor.

The feeder means is advantageously a shaker feeder known in itself in the art where the objects are with the aid of a guided shaking arranged at least into one individual row where the objects are placed into a successively uniform position. A variety of such shaker feeders are available commercially, and they are well known to a person skilled in the art.

The block in the travel path of the painted objects can be a thread stretched across the magnetic conveyor and sweeping the magnets thereof, or something equivalent. A detaching means like this is very simple and cheap, though efficient.

The paint spreading members are electrostatic powder nozzles known themselves in the art with which paint powder is spread electrostatically on metal objects gliding on a thin sheet. Thereafter, the metal objects can be transferred with the aid of a magnetic conveyor to a heating means, such as an IR heater where the metal objects are heated to such a high temperature at which the paint powder on the surface thereof melts and becomes a network, thus providing a hard and durable coating on said metal objects.

The thin sheet with which the metal conveyor is separated from the head-provided metal objects at least during the painting is a sheet made preferably from stainless steel or aluminium, which in conjunction with electrostatic painting is grounded.

As taught by the invention, the painting line is particularly appropriate for painting elongated objects, such as screws, nails and bolts, which are provided with a head, for instance coating screws and nails having a washer, which on the magnetic conveyor are carried at the narrow top part.

BRIEF DESCRIPTION OF THE DRAWINGS

The invention is described below more closely referring to the accompanying drawings, in which.

DETAILED DESCRIPTION OF THE INVENTION

Figure 1:
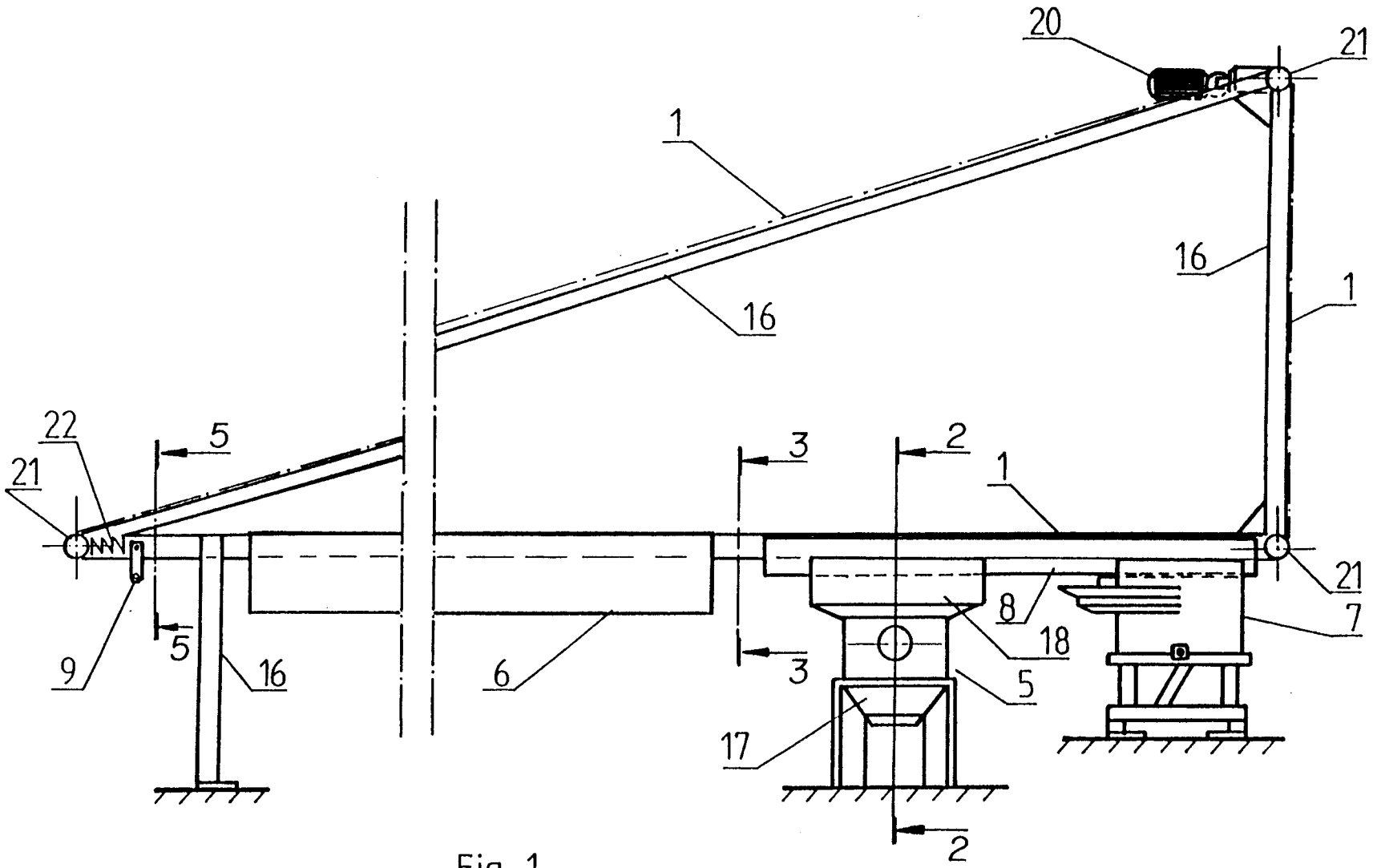
FIG. 1 presents a vertical image of a painting line of the invention.

The frame structure of the painting line presented in FIG. 1 is indicated by reference numeral 16 and in upright position it forms a right-angled triangle with the lower side, or the long leg being substantially horizontal. The heads of the triangular frame structure 16 are provided with deflection sheaves 21, above which an endless magnetic conveyor has been taken, generally indicated by reference numeral 1.

The deflected sheave 21 at the sharp end of the triangular frame structure 16 is further provided with a spring 22 with the aid of which the magnetic conveyor 1 can be kept tight. In addition, the topmost deflected sheave 21 is provided with an engine 20 with the aid of which the magnetic conveyor 1 is driven clockwise. To a first end of a horizontal part of the frame structure 16, a thin sheet 8 of U-shaped cross-section made from stainless steel or aluminium has furthermore been mounted, forming together with the horizontal first part of the frame structure 16 a duct open at both ends, inside which the magnetic conveyor 1 moves gliding along the top surface of the stem of the thin sheet 8.

Figure 3:
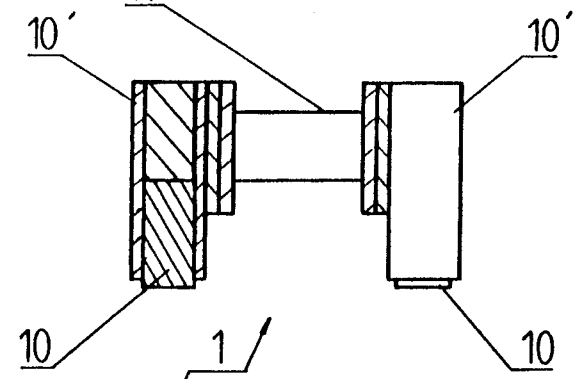
FIG. 3 shows a section along the line B—B in FIG. 1.
Figure 4:
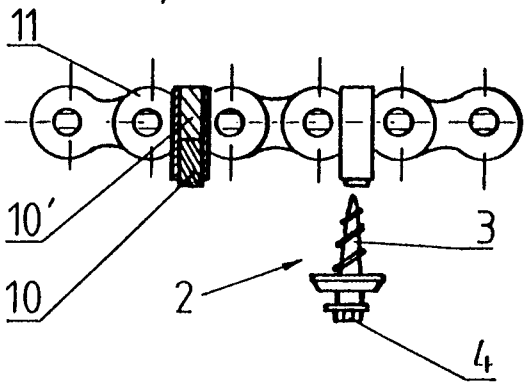
FIG. 4 presents a partly sectioned elevational view of a part of a magnetic conveyor and a coating screw attached thereto.

As seen more in detail in FIGS. 3 and 4, the magnetic conveyor 1 consists of a conveyor chain 11 which on both sides in vertical plane and in the longitudinal direction of the magnetic conveyor 1 has evenly spaced sleeve-like magnetic holders 10' whereinside magnets 10 are disposed in vertically outward position from said magnet holders 10' and said carrier loop, said magnets being on the horizontal lower part of the magnetic conveyor 1 directed vertically downwards, that is, transversally against the longitudinal direction of the conveyor.

Below a first end of the horizontal lower part of the triangular frame structure 16 is furthermore provided a shaker feeder, manufactured by Central Automated Systems Inc., Indianapolis, US., composed of two adjacent round troughs, to the middle part of which coating screws 2 to be painted are fed, which by the action of the shaker feeder stand up in upright position supported by the base 4, with the tips 3 in upward position and moving onto a spirally ascending track located on the circumference of each trough, said track being so narrow that two adjacent individual rows are formed under a thin sheet 8 and so close thereto that the coating screws are attracted to the sheet 8 by the action of the magnetic conveyor 1 moving along the top surface of the stem part thereof and move along with the conveyor 1 on the undersurface of the sheet 8 into a painting chamber 5 shown more in detail in FIG. 2.

Figure 2:
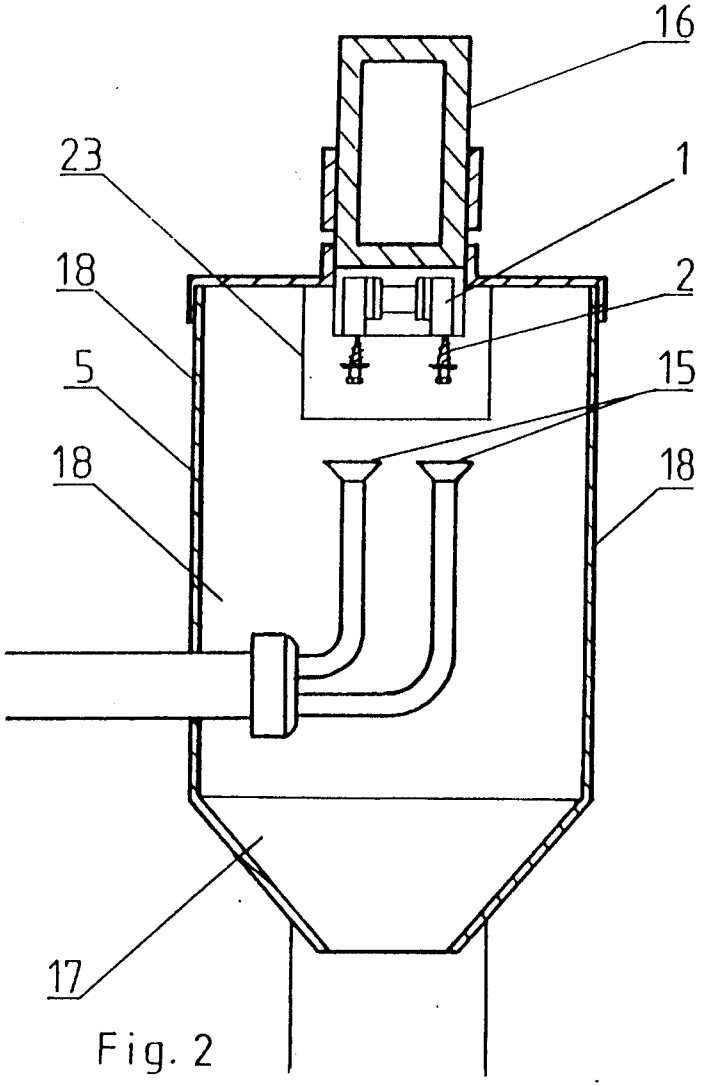
FIG. 2 shows a section along the line A—A in FIG. 1.

The painting chamber shown in FIG. 2 is provided with side walls 18 and end walls 18', said walls being however provided with an aperture 23 intended for the coating screws 2 to be painted moving against the undersurface of the thin sheet 8. The lower part of the chamber 5 is furthermore provided with a funnel 17 for recovering excess paint powder into a collector vessel (not shown) located below said funnel 17. Moreover, nozzles 15 are provided through the other side wall 18 of the chamber 5 through which polyester powder is sprayed as fine dispersion into the chamber 5. The polyester powder has prior to the spraying into the chamber 5 been provided with positive charge created by the aid of friction, and after grounding the thin sheet 8, the positively charged polyester powder sprayed into the chamber 5 attaches to the metallic coating screws which at the ends are hanging from the undersurface of the thin sheet 8. The paint powder can thus be spread very uniformly on the surface of the coating screws, and particularly on the bases and washers thereof.

The thin sheet 8 ends right after the electrostatic powder painting chamber 5, whereby the coating screws 2 coated with paint powder remain hanging by the tips 3 on the magnets 10, thus moving along with the magnetic conveyor 1 to a heating zone 6, containing thereinside IR heating elements, with the aid of which the metallic coating screws are heated to such a high temperature, over 200° C., that the polyester powder melts into a uniform layer on the coating screws and forms a network, providing a hard and durable coating.

Figure 5:
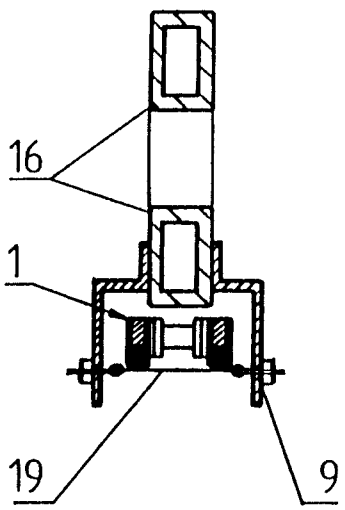
FIG. 5 presents finally a section along the line C—C in FIG. 1.

After the heating means 6, the painted coating screws 2 hanging from the magnetic conveyor 1 are dropped off from the conveyor by means of a block 9 placed at the rear end of the horizontal part, shown more closely in FIG. 5.

As seen more closely in FIG. 5, a thin metallic thread 19 is stretched below the magnetic conveyor 1, below the travel path of the coating screws 2, and in the level of the upper part of the tips 3 of the coating screws, to prevent said coating screws 2 from moving together with the magnets 10 of the magnet conveyor 1, with the result that the coating screws 2 drop off from the track. The painted coating screws 2 can in this manner very easily be detached from their track and recovered in a collector vessel (not shown) therebelow.

It is obvious to a person skilled in the art that the invention can be modified in a wide variety of ways within the scope of the accompanying claims. The endless magnetic conveyor need not travel along the triangular track, neither needs the track be placed in upright position, on the contrary, it can be in the horizontal plane, whereby the magnetic holders with the magnets are located on the outer side of the chain conveyor. The magnets may attract the sides of the tips, instead of the actual tips, for obtaining a wider attraction surface and better engagement.

Instead of a shaker feeder, another feeding apparatus can be used with the aid of which the head-provided metal objects to be painted can be arranged in one or more single rows either below the magnetic conveyor or on the side/sides thereof. The painting line may also be located below the upper part of an endless conveyor loop.

Paint may also be spread in some other way than electrostatically, but it is obvious that the spreading of the paint must be so gentle that the metal objects to be painted will not detach from the magnetic conveyor.

No heating means is necessarily needed if a paint is used which dries or hardens fast enough, or the hardening can be provided with other means, e.g. with air current.

The painted metal objects can be detached from the magnetic conveyor in many ways. The detaching element placed on the travel path of the painted objects may therefore also be a nozzle disposed besides the travel path, focussing vigorous air current against the painted metal objects in order to detach them from the conveyor. The element may also be a shaker.

For detaching the paint powder possibly caught on the magnetic conveyor, the painting line may be provided with brushes, air spraying nozzles, or similar objects placed at appropriate locations to clean the conveyor. Also in the painting chamber, some nozzles may be inserted to focus the air current on the narrow end of the objects to be painted, in order to prevent the paint powder from being caught on said parts, which in some instances may be preferable considering the use of head-provided metal objects.

I claim:

1. A painting line for metal objects, comprising a base for affixing objects (2) at a space from one another on said base, paint spreading members (5) for spreading paint on said objects affixed on said base, and heating elements (6) for fixing the paint on the objects prior to detaching these from the base, characterized in that the base is a magnetic conveyor (1) provided with a feeder (7) for organizing objects (2) in one or more adjacent individual rows to join on the magnetic conveyor and a thin sheet (8) positioned between the magnetic conveyor (1) and the objects (2) such that the objects are attracted from each row to the sheet (8) by the magnetic conveyor (1) and move with the magnetic conveyor (1) whereby the paint spreading members (5) are positioned after the feeder (7) in the travel path of the magnetic conveyor (1) and are separated from the magnetic conveyor by the thin sheet (8), the thin sheet extending along the travel path of the magnetic conveyor for at least a distance sufficient to protect the conveyor from the paint spreading members, against which sheet the objects (2) glide due to the action of the magnetic conveyor (1) gliding against the opposite side of said sheet, and that subsequent to the heating elements (6) which are positioned along the travel path of the magnetic conveyor (1) after the paint spreading members (5), a member (9) is provided on the travel path of the painted objects (2) conveyed by the magnetic conveyor, for dropping said objects off from the magnetic conveyor (1).

2. The painting line according to claim 1, wherein the magnetic conveyor (1) is an endless chain conveyor (11) or equivalent, provided with a plurality of permanent magnets (10) at least at a longitudinal space from one another.

3. The painting line according to claim 1 or 2, characterized in that the feeder (7) is a shaker feeder in which the objects (2) with the aid of directed shaking are arranged at least into one individual row.

4. The painting line according to claim 3 wherein the member (9) on the travel path of the painted objects (2) is a thread (19) stretched across the magnetic conveyor (1), in the immediate vicinity thereof, past which the magnets (10) sweep.

5. The painting line according to claim 4 wherein the paint spreading members (5) are electrostatic powder nozzles (15) with which paint powder is spread electrostatically on the metal objects (2) gliding along the thin sheet.

6. The painting line according to claim 5 wherein the thin sheet (8) is made from stainless steel.

7. The painting line according to claim 5 wherein the thin sheet is made from aluminum.

8. The painting line according to claim 1 wherein a plurality of permanent magnets are provided on both sides of a chain conveyor.

* * * * *